US008245651B1

(12) United States Patent
Mikich et al.

(10) Patent No.: US 8,245,651 B1
(45) **Date of Patent: *Aug. 21, 2012**

(54) SUSPENDED STORAGE DEVICE

(76) Inventors: Michael J. Mikich, Las Vegas, NV (US); Dwayne Dunseath, Las Vegas, NV (US); Timothy M. Matthias, Las Vegas, NV (US); Mark C. Torosian, Las Vegas, NV (US)

( * ) Notice: Subject to any disclaimer, the term of this patent is extended or adjusted under 35 U.S.C. 154(b) by 890 days.

This patent is subject to a terminal disclaimer.

(21) Appl. No.: 11/644,359

(22) Filed: Dec. 22, 2006

Related U.S. Application Data

(63) Continuation-in-part of application No. 10/768,225, filed on Jan. 30, 2004, now Pat. No. 7,152,535, which is a continuation-in-part of application No. 09/966,929, filed on Sep. 28, 2001, now Pat. No. 6,715,427, which is a continuation-in-part of application No. 09/690,654, filed on Oct. 17, 2000, now Pat. No. 6,435,105.

(51) Int. Cl.
*A47B 23/00* (2006.01)

(52) U.S. Cl. ..... 108/42; 211/113

(58) Field of Classification Search ..... 108/42, 108/149, 186, 64, 67; 211/113, 181.1, 118, 211/117, 119
See application file for complete search history.

(56) References Cited

U.S. PATENT DOCUMENTS

| | | | | |
|---|---|---|---|---|
| 276,241 | A | 4/1883 | Hanavan | |
| 1,566,551 | A | 12/1925 | Ghrand | |
| 2,458,332 | A | 1/1949 | Boschan | |
| 2,549,242 | A * | 4/1951 | Ross | 108/15 |
| 3,139,045 | A * | 6/1964 | Rojakovick | 108/109 |
| 4,582,001 | A | 4/1986 | Leikarts | |
| 4,656,952 | A | 4/1987 | Schweizer | |
| 4,729,483 | A | 3/1988 | Schrader | |
| 5,199,843 | A * | 4/1993 | Sferra | 414/592 |
| 5,695,079 | A | 12/1997 | Peay | |
| D416,152 | S | 11/1999 | Payne et al. | |
| 6,016,928 | A | 1/2000 | Cothran et al. | |
| 6,145,678 | A * | 11/2000 | Morrison | 211/113 |
| 6,161,709 | A | 12/2000 | Kluge et al. | |
| 6,286,691 | B1 | 9/2001 | Oberhaus et al. | |
| 6,318,570 | B1 | 11/2001 | Mueller et al. | |
| 6,409,031 | B1 | 6/2002 | Wynne | |
| D459,926 | S | 7/2002 | Mikich et al. | |
| 6,435,105 | B1 | 8/2002 | Mikich et al. | |

(Continued)

OTHER PUBLICATIONS

Ortho Books, How to Design & Build Storage Products, book, 1983, p. 78, Robert L. Iacopi, San Ramon, CA, US.

(Continued)

*Primary Examiner* — José V Chen
(74) *Attorney, Agent, or Firm* — TechLaw LLP

(57) ABSTRACT

A suspended storage shelf includes a platform supported by a support frame having at least one platform support element and at least two suspension posts, optionally adjustable in length, attached a platform support element. A fastener secures the support frame to a structure. Optionally, the suspension posts are attachable over a continuous or discrete range of locations on the platform support element. In an embodiment with two or more panels, the panels form a continuous surface by, for example, being positioned adjacent one another along the platform support element, being secured to one another such as with a coupling, and/or being secured to the platform support element. Optionally, the panels are positioned along the platform support element and the length of the platform support element is such that the suspension posts clamp the panels in adjacency.

23 Claims, 14 Drawing Sheets

U.S. PATENT DOCUMENTS

| | | | | |
|---|---|---|---|---|
| D470,353 | S | 2/2003 | Mikich et al. | |
| 6,715,427 | B2 | 4/2004 | Mikich et al. | |
| 7,152,535 | B2 * | 12/2006 | Mikich et al. | 108/42 |

OTHER PUBLICATIONS

Parsteel Shelving Co., http://www.parsteel.com, web page, Oct. 7, 2000, Hialeah, FL, US.

Salco, http://www.salcoeng.com, web page, Jan. 25, 1999, US.

*Hyloft, Inc.* v. *Jiangsu Sainty Shengtong Imp. & Exp. Co., Ltd. et al.*, Case No. CV Jul. 5819 AHM(PJWx), Civil Minutes, Nov. 30, 2007, pp. 1-18, Central District of California, US.

* cited by examiner

SUSPENDED STORAGE DEVICE

RELATED APPLICATION DATA

The present application is a continuation-in-part of U.S. patent application Ser. No. 10/768,225 entitled "Suspended Storage Shelf" filed Jan. 30, 2004, now U.S. Pat. No. 7,152,535 which was a continuation-in-part of U.S. patent application Ser. No. 09/966,929 entitled "Suspended Storage Structure" filed Sep. 28, 2001, now U.S. Pat. No. 6,715,427, which, in turn, was a continuation-in-part of U.S. patent application Ser. No. 09/690,654 entitled "Suspended Storage Structure" filed Oct. 17, 2000, now U.S. Pat. No. 6,435,105.

FIELD OF THE INVENTION

The present invention relates to shelving. More specifically, the present invention is a storage shelf suspended beneath a structure.

BACKGROUND OF THE INVENTION

Suspended storage structures, including Applicant's own prior U.S. Pat. Nos. 6,435,105 and 6,715,427 and U.S. Design Pat. Nos. 459,926 and 470,353, all incorporated herein by reference, are known in the art. Examples of suspended structures are also shown in references assigned to Applicant, such as U.S. Pat. No. 6,409,031 and U.S. Design Pat. No. 416,152, also incorporated herein by reference. These devices, along with the present invention, are intended to address some of the drawbacks of other suspended storage structures.

SUMMARY OF THE INVENTION

A storage shelf for suspending from a structure includes a platform. Optionally, the platform is formed by individual panels. The platform is supported by a support frame. In one optional embodiment, the support frame has at least one platform support element and at least two suspension posts. In an optional embodiment, a plurality of platform support elements are provided. In one such optional embodiment, the platform support elements engage and support the perimeter of the platform.

In one optional embodiment, the platform support elements and suspension posts may optionally be integrally formed. In another optional embodiment, the suspension posts are connectable to the platform support element at a plurality of locations relative to one another along the platform support element(s). In such an optional embodiment, the suspension posts may be connectable to the platform support element(s) at a plurality of discrete locations along the platform support element or may be connectable to the platform support element(s) over a continuous range of locations along the platform support element. For example, in an optional embodiment in which the suspension post is connectable to the platform support element over a continuous range of locations, the suspension post may slide along a platform support element to permit adjustment in the spacing between suspension posts. In an optional embodiment with a plurality of platform support elements, the suspension posts may be connectable to any of the platform support elements. That is, the suspension posts of one such optional embodiment may be connectable to any of the platform support elements, and in any of a plurality of locations along those platform support elements.

In an optional embodiment, the support frame includes connectors attached to the suspension posts. Optionally, the connector includes a lock having a locked configuration, in which the connector is secured to the platform support element, and an unlocked configuration, in which the connector and the platform support element are free to move with respect to one another. While the connectors could take any form, in an optional embodiment, the connectors are in the form of a support flange against which said platform support element rests, and the lock is in the form of a locking plate that removably attaches to the suspension post with the frame element held to the support flange.

A fastener secures the support frame to the structure such that the platform support element and suspension post cooperate to suspend the platform from the structure.

In one optional embodiment, the platform support element has two ends, each of which extend beyond the platform. In one optional embodiment, the panels are of substantially equal length and a platform support element is an integer multiple of the panel length. In such an optional embodiment, support frame may include a suspension post attached to each platform support element end.

In an optional embodiment, the suspension post or posts are of adjustable length. For example, in one optional embodiment the suspension post includes at least two post elements and the length of the suspension post is adjusted by selectively joining the post elements.

In an optional embodiment in which the platform is formed from a plurality of panels, the panels may form a substantially continuous support surface by, for example, positioning the panels adjacent one another along the platform support element, securing each panel to an adjacent panel, and/or securing each panel to the platform support element. In one such optional embodiment, the storage shelf includes a coupling securing adjacent panels. In one particular optional embodiment, the panels are formed from a grid of wire members and the coupling comprises a clamp securing adjacent wire members of adjacent panels. In another optional embodiment, the coupling comprises a hinge connecting adjacent panels. In yet another optional embodiment, the panels are positioned along the platform support element and the length of the platform support element is such that the suspension posts retain the panels in adjacency.

DESCRIPTION

Figure 1:
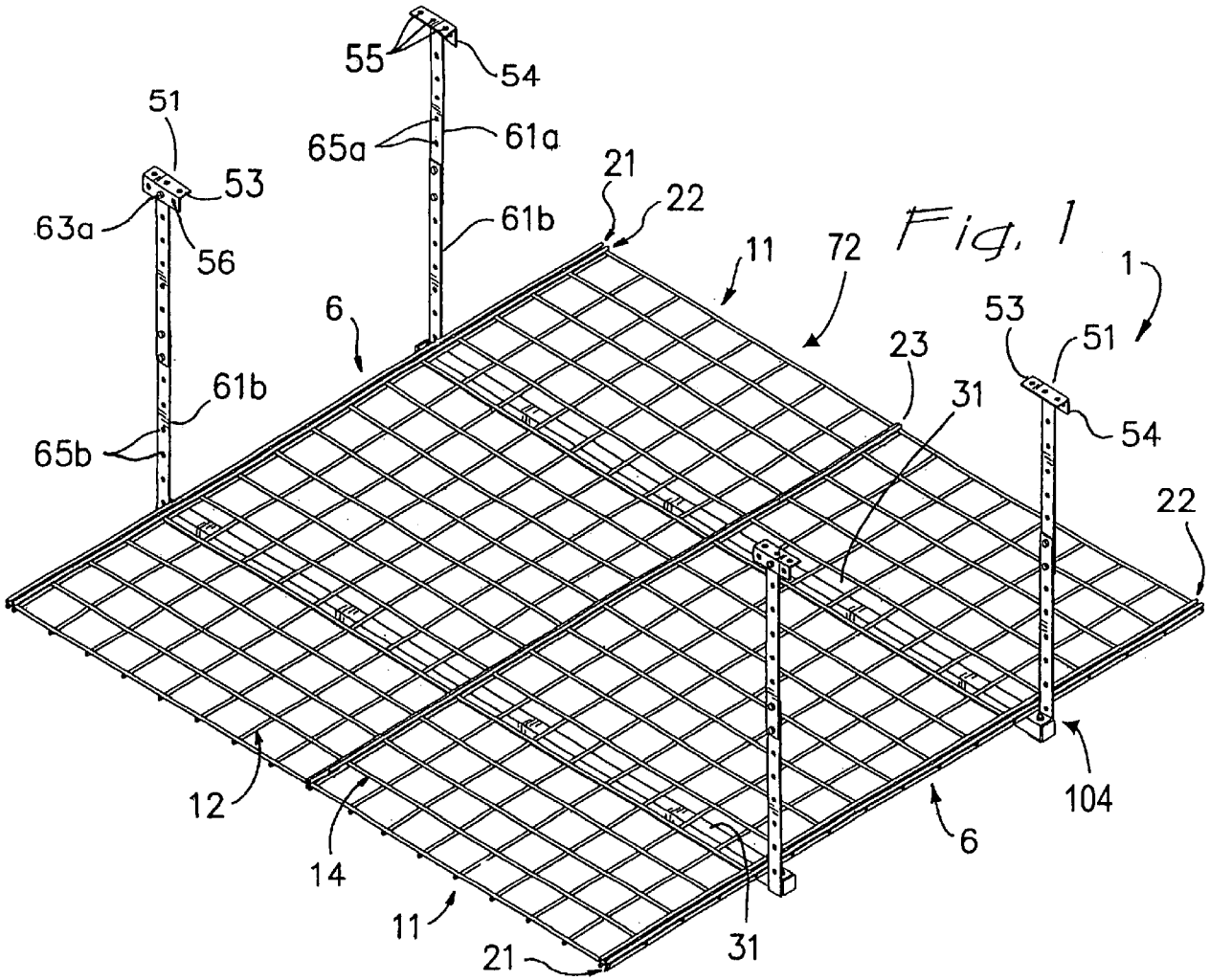
FIG. 1 shows an elevated perspective view of an embodiment of a suspended storage shelf according to the present invention.

Reference is now made to the figures wherein like parts are referred to by like numerals throughout. Referring generally to FIGS. 1-18, the present invention is a suspended storage shelf 1. The storage shelf 1 is suspended from an overhead structure 100 such as a ceiling or other overhead surface. The storage shelf generally includes a platform 72, a support frame 104 having at least one platform support element 31 and at least two suspension posts 61, and a fastener 51.

The storage shelf 1 includes a platform 72 formed by one or more individual panels 11. The panels 11 may take any shape, but in an optional embodiment, the panels 11 are planar. Also, while the panels 11 may have any construction, including solid construction, in an optional embodiment, the panels 11 are formed from a wire grid in which wire members 12, 14 cooperate to form the panels 11. In an optional embodiment, multiple platforms 72 may be provided, with the platforms 72 disposed parallel to one another and separated along the suspension posts 61.

As stated, only one panel 11 is needed to form the platform 72. However, it is also contemplated that multiple panels 11 may be used to form the platform 72. In an optional embodiment including two or more panels 11, the panels 11 may be arranged to form a substantially continuous surface. This may occur in many different ways. For example, in one optional embodiment, such as that shown in FIGS. 5, 6, and 13, each panel 11 is secured to an adjacent panel 11, such as through a coupling or a hinge. In an optional embodiment, the coupling is a clamp 101, such as that formed from a mating bolt 102 and nut 103, that secure and retain adjacent wire members 23 along the edges 9 of adjacent panels 11 in substantial contact.

Figure 2:
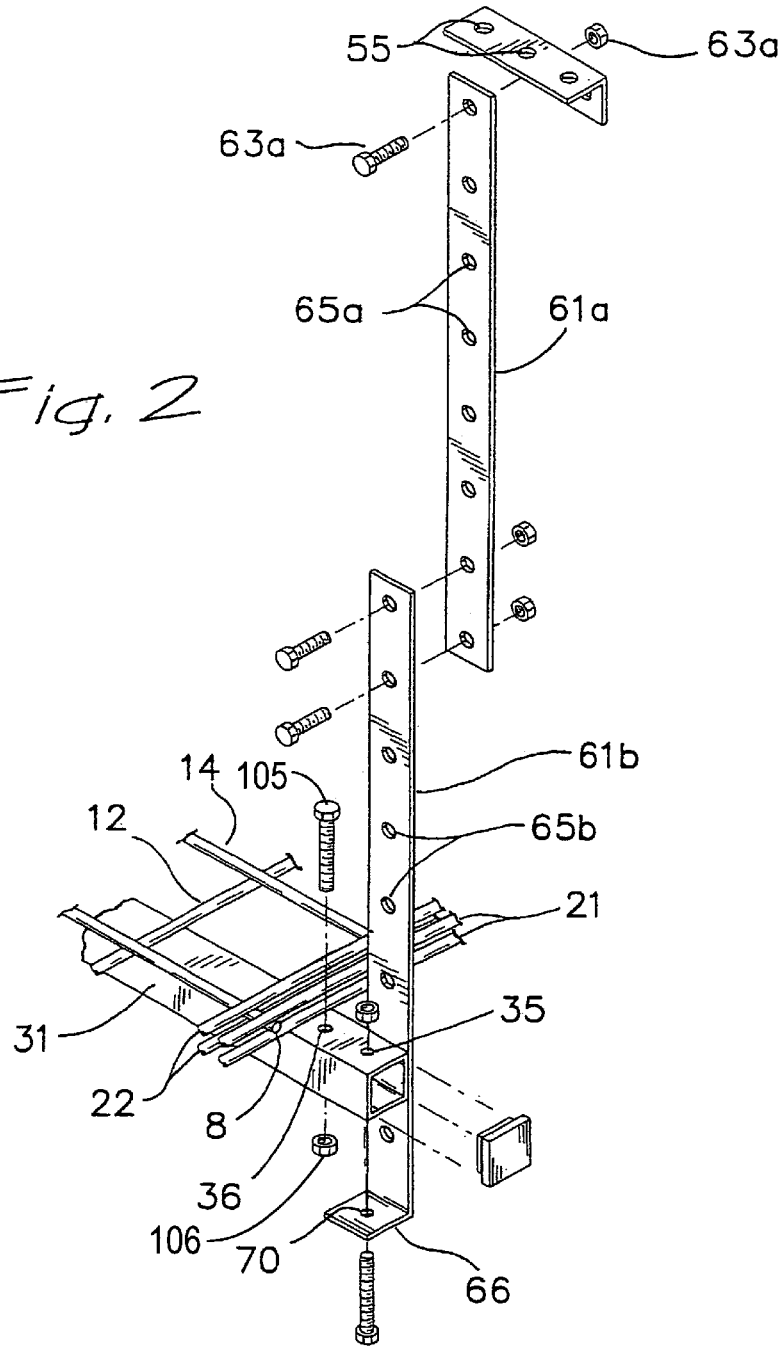
FIG. 2 shows a perspective assembly view of an embodiment of a suspended storage shelf according to the present invention.
Figure 3:
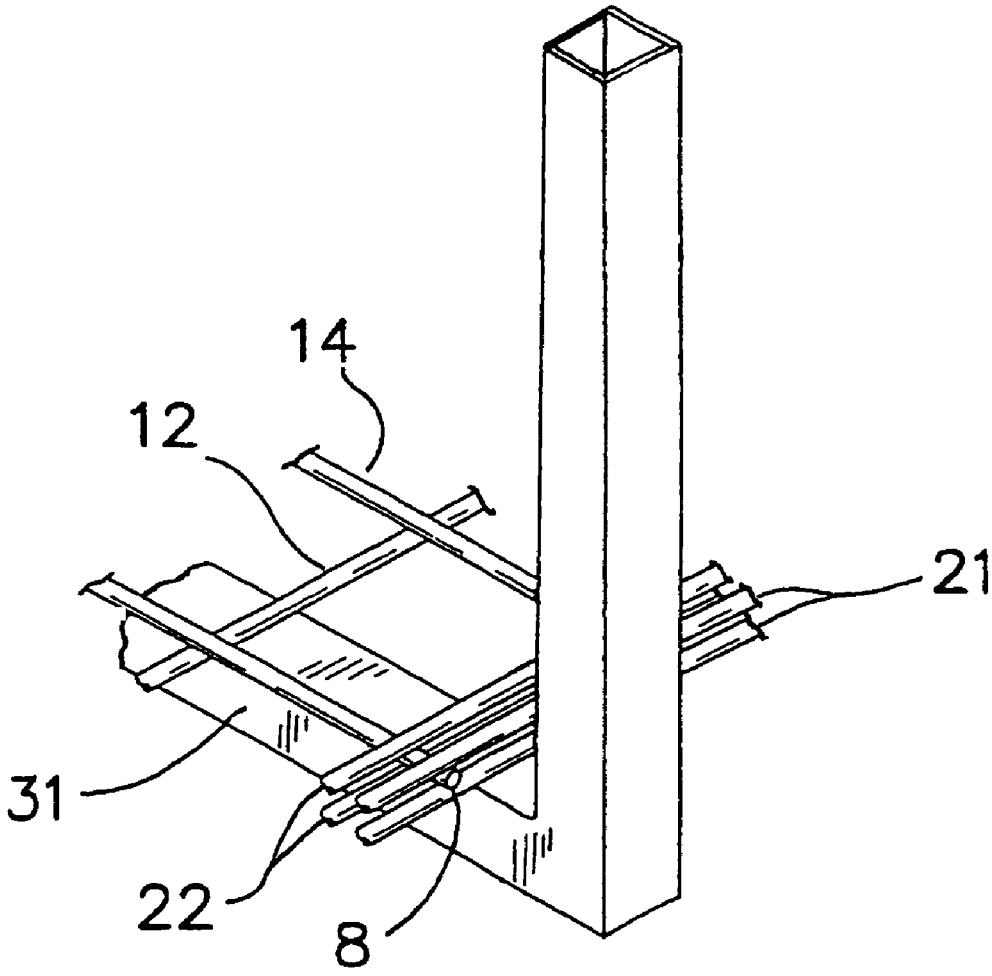
FIG. 3 shows a perspective assembly view of an alternate embodiment of a suspended storage shelf according to the present invention.
Figure 4:
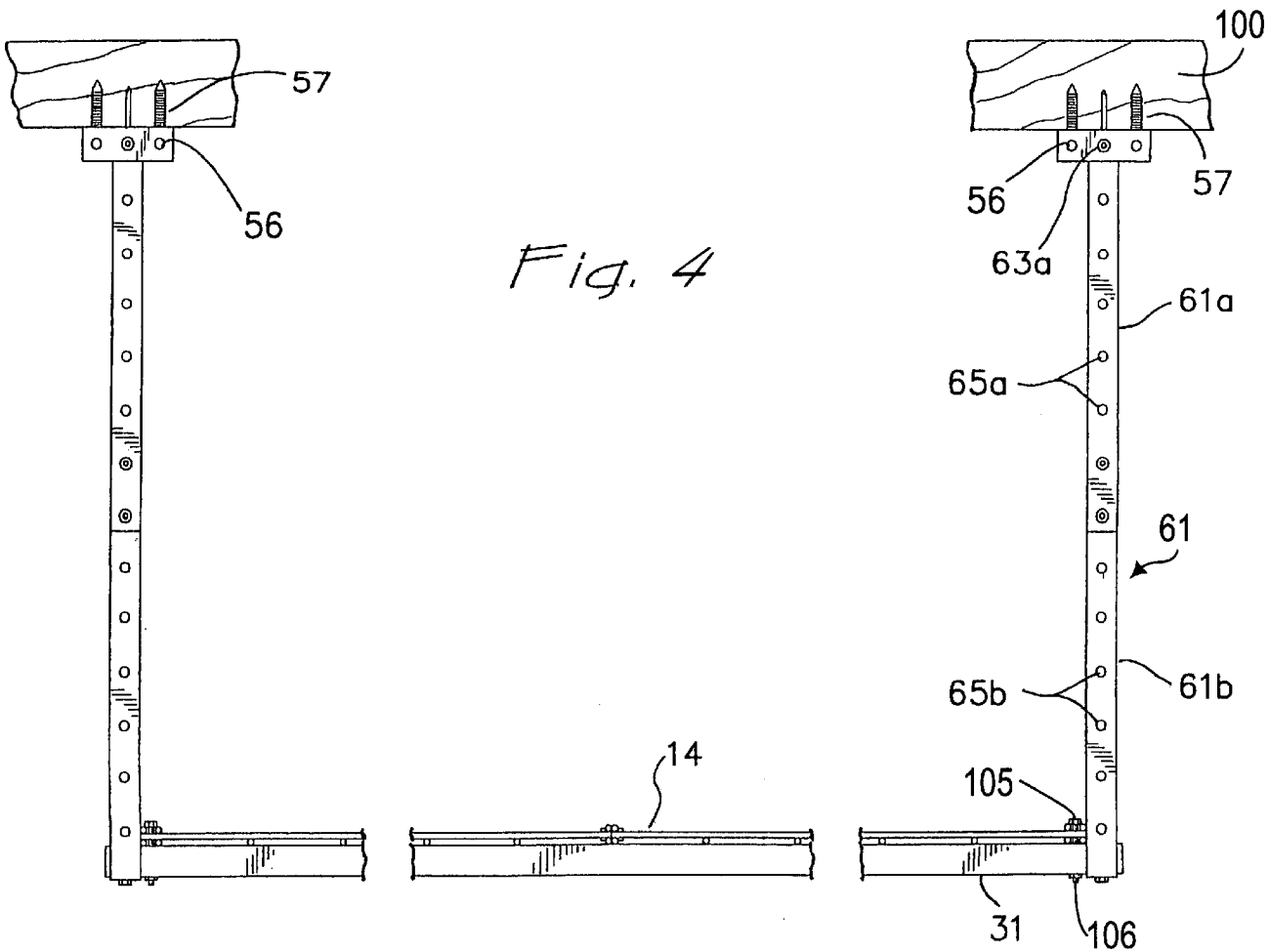
FIG. 4 shows an end view of an embodiment of a suspended storage shelf according to the present invention mounted to a structure.
Figure 5:
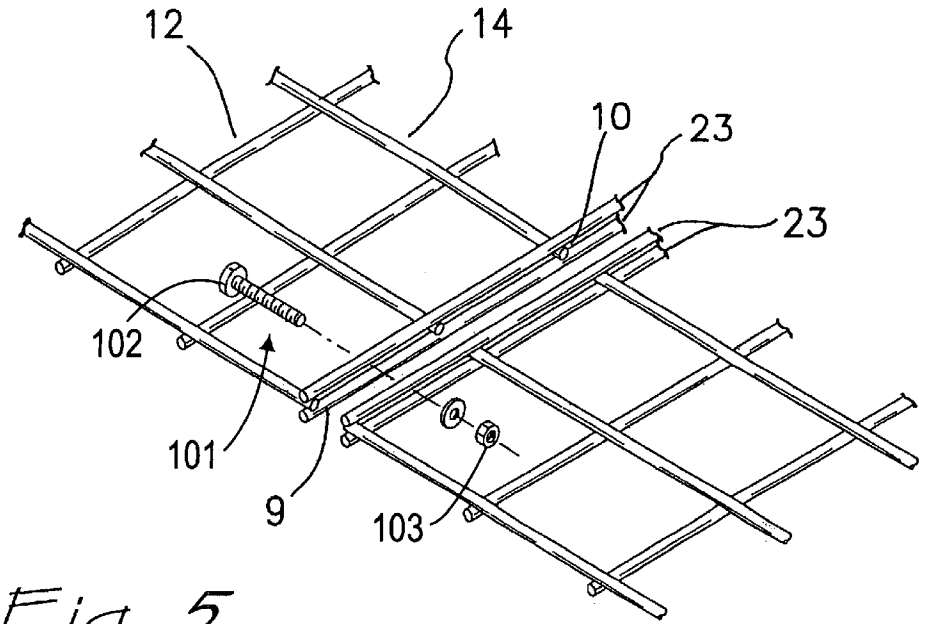
FIG. 5 shows a perspective assembly view of an embodiment of a coupling according to the present invention.
Figure 6:
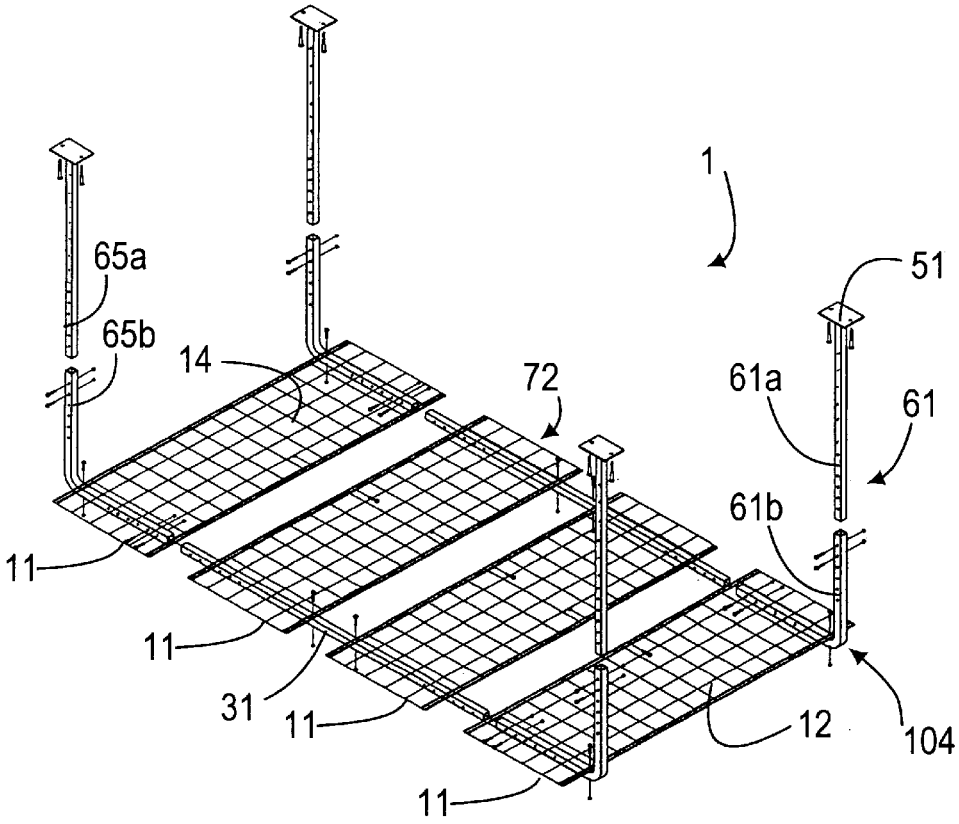
FIG. 6 shows a perspective assembly view of an alternate embodiment of a suspended storage shelf according to the present invention.
Figure 7:
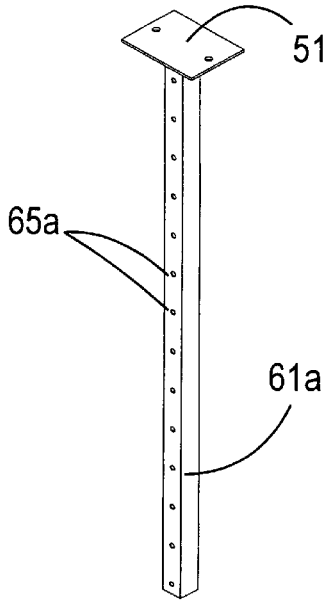
FIG. 7 shows an elevated perspective view of a fastener and suspension post element according to the optional embodiment of FIG. 6.
Figure 8:
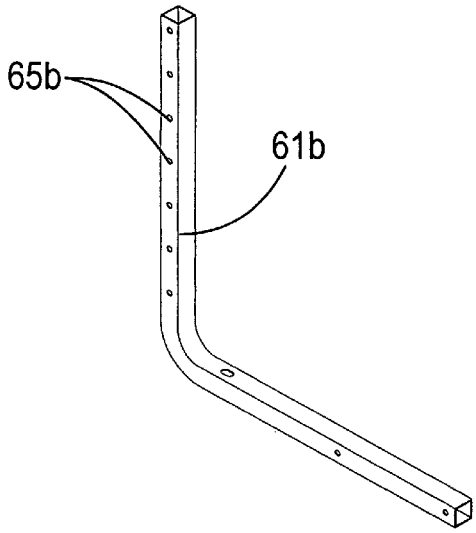
FIG. 8 shows a perspective view of a suspension post element according to the optional embodiment of FIG. 6.

In another optional embodiment, such as that shown in FIGS. 2 and 4, the panels 11 are formed into a substantially continuous surface by securing each panel 11 to a platform support element 31. For example, a mating bolt 105 and nut 106 threaded through a hole 36 in the platform support element 31 and through a gap between wire elements 21, 22 may secure and retain panels 11 to the platform support element 31 adjacent one another.

Figure 9:
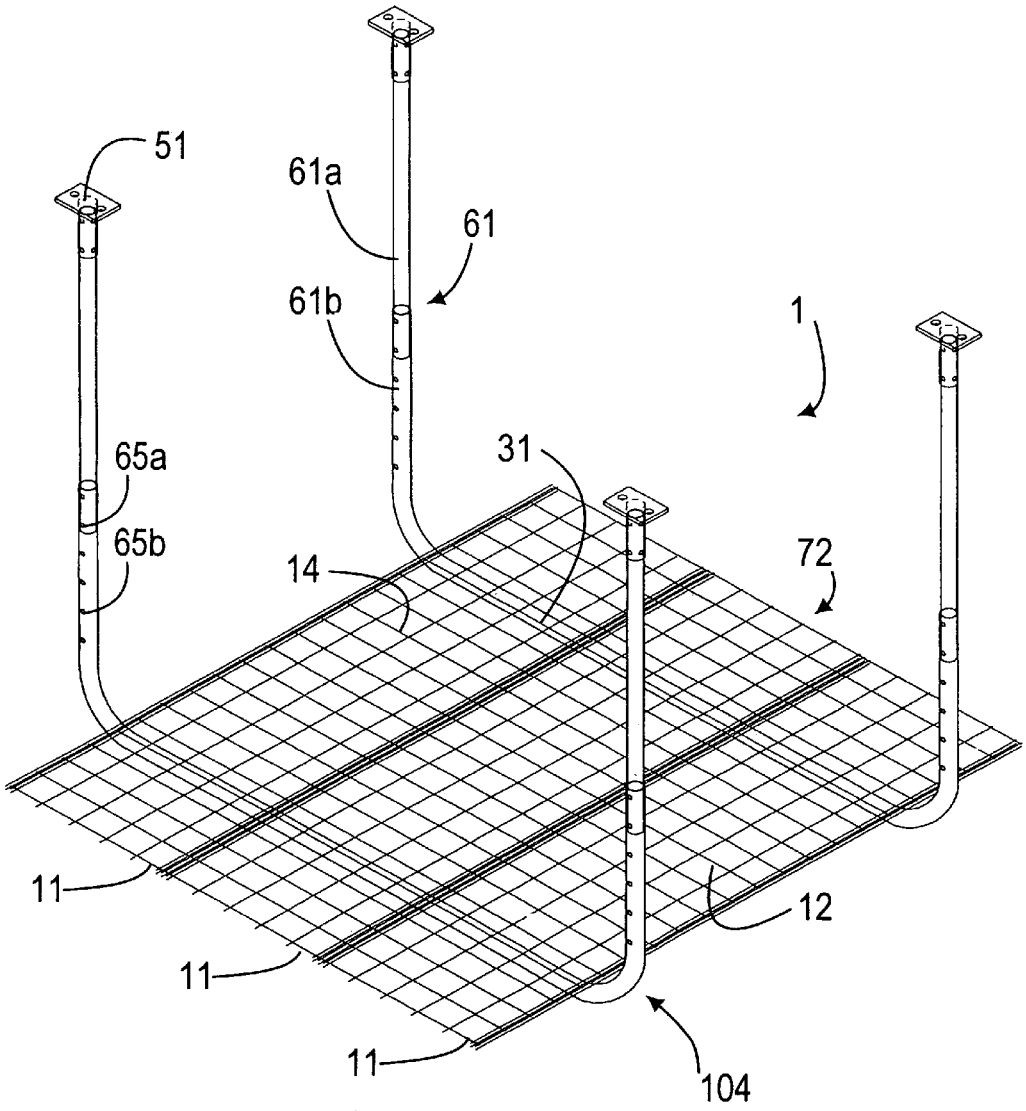
FIG. 9 shows an elevated perspective view of an alternate embodiment of a suspended storage shelf according to the present invention.
Figure 10:
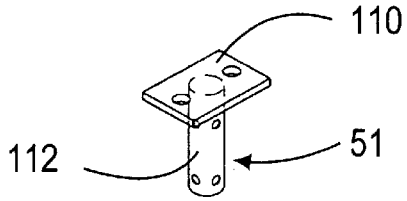
FIG. 10 shows an elevated perspective view of a fastener according to the optional embodiment of FIG. 9.
Figure 11:
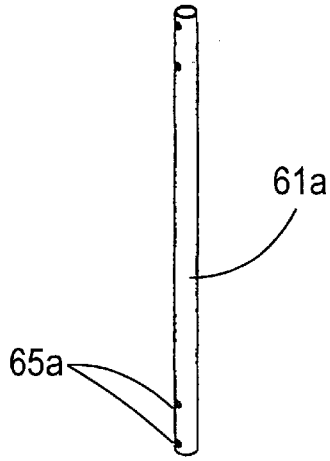
FIG. 11 shows an elevated perspective view of a suspension post element according to the optional embodiment of FIG. 9.
Figure 12:
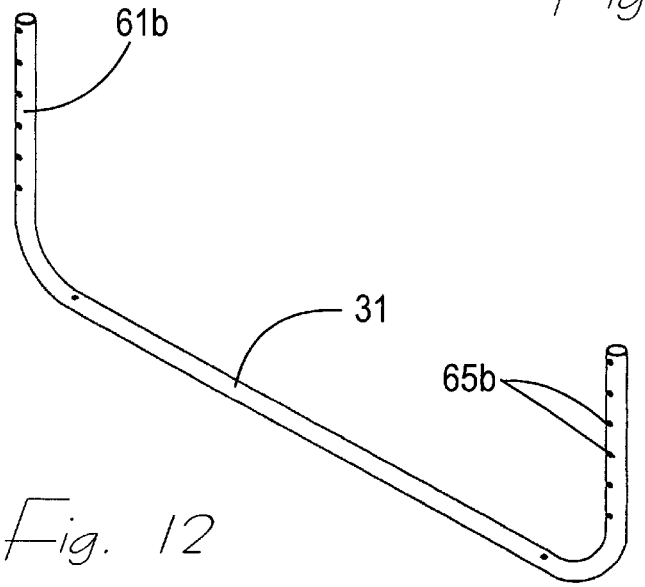
FIG. 12 shows an elevated perspective view of a suspension post element and platform support element according to the optional embodiment of FIG. 9.
Figure 16:
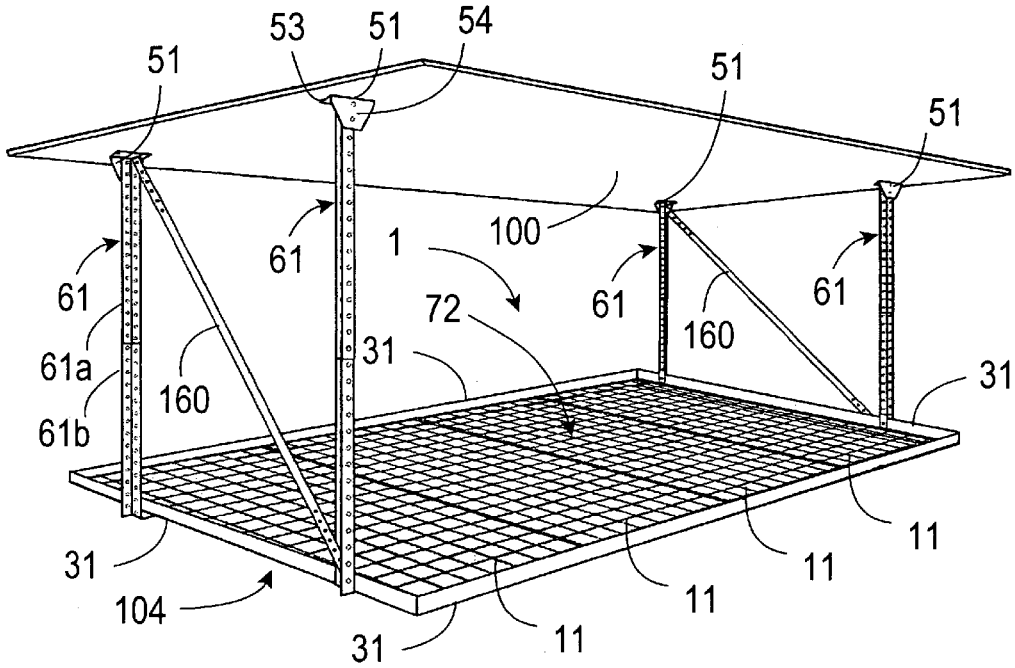
FIG. 16 shows an elevated perspective view of a suspended storage shelf according to an optional embodiment of the present invention.

In one optional embodiment, such as that shown in FIGS. 1, 9, 16, and 17, the panels 11 are positioned along a platform support element 31 in adjacent relationship so that the panels 11 cooperate to form a substantially continuous surface. In one optional embodiment, the panels 11 may be oriented with the edges 9 of adjacent panels 11 perpendicular to the platform support element 31 such that the platform support element 31 prevents the panels 11 from separating. In this embodiment, as well as the other embodiments described, the platform support element 31 may be of a length that the platform support element 31 is sized to the platform 72 so that the panels are held in adjacency. Optionally, as shown in FIGS. 1 and 9, the spacing of the suspension posts 61 may also aid in retaining the panels 11 in adjacency, although, as shown in FIG. 16, this is not necessary. In one particular optional embodiment, the panels 11 are of substantially equal length and the platform support element 31 is an integer multiple of the panel length to accommodate an integer number of panels 11.

Turning to the support frame 104, as discussed above, the support frame 104 includes at least one platform support element 31 attached to at least two suspension posts 61. It should be noted that although the terms "frame," "frame element," and "post" usually connote narrow, elongate structures, it is contemplated that the support frame 104, platform support element 31, and/or suspension posts 61 may be flat and/or planar to aid in supporting the platform 72. In the optional embodiment of FIGS. 1 and 2, for example, each of two platform support elements 31 are connected to a lower end of two suspension posts 61. While the optional embodiment of FIGS. 1 and 2 shows each platform support element 31 attached to a suspension post 61 at its ends, it is contemplated that the suspension posts 61 could be attached to the platform support element 31 at any point along the length of the platform support element 31. Similarly, although the optional embodiment of FIGS. 1 and 2 show the ends of the platform support element 31 extending beyond the edges 6 of the platform 72, it is contemplated that the platform support element 31 may be of any length, either longer or shorter, with respect to the platform 72. In other embodiment, such as that shown in FIGS. 6-12, the platform support element 31 and suspension posts 61 are connected through a corner joint that serves to form a suspension post element 61*b* as well as a portion, shown of FIG. 8, or all, shown in FIG. 12, of the platform support element 31. It is noted that the platform support element 31 need not necessarily be unitary and may optionally comprise joined sections as shown in the optional embodiments of FIGS. 6-8.

In the optional embodiments of FIGS. 1-13, the platform support elements 31 are akin to a support beam supporting the platform 72 from beneath. That is, in an optional embodiment, the platform support elements 31 are subjacent to the platform 72, optionally along the face of the platform 72. In another optional embodiment, shown in FIGS. 14-17, a plurality of platform support elements 31 may be assembled together to frame and support the platform 72, optionally along its perimeter. That is, in an optional embodiment, the platform support elements 31 are subjacent to the platform 72, optionally along its edges. In yet another optional embodiment, the platform support elements 31 may be partially subjacent to, integrated with, or superjacent and attached to, the platform 72, while still providing support for the platform 72.

The platform support elements 31 and suspension posts 61 may be attached to one another in a non-permanent, or even releaseable fashion. For example, in the optional embodiment of FIG. 2, an L-shaped flange 66 at the lower end of the suspension posts 61 may include a hole 70 that aligns with a hole 35 in the platform support element 31. A mating nut and bolt threaded through the aligned holes 35, 70 attach the flange 66, and consequently the suspension post 61, to the platform support element 31. In an alternate optional embodiment, shown in FIG. 3, the platform support elements 31 and suspension posts 61 are integrally formed. For example, a platform support element 31 and suspension posts 61 could be formed into a U-shape with the platform support element 31 disposed between two suspension posts 61, such as the embodiment shown in FIGS. 6 and 9, or an O-shape substantially similar to the U-shaped form but with an extra support frame member connecting the ends of the suspension posts 61 opposite the platform support element 31.

Figure 17:
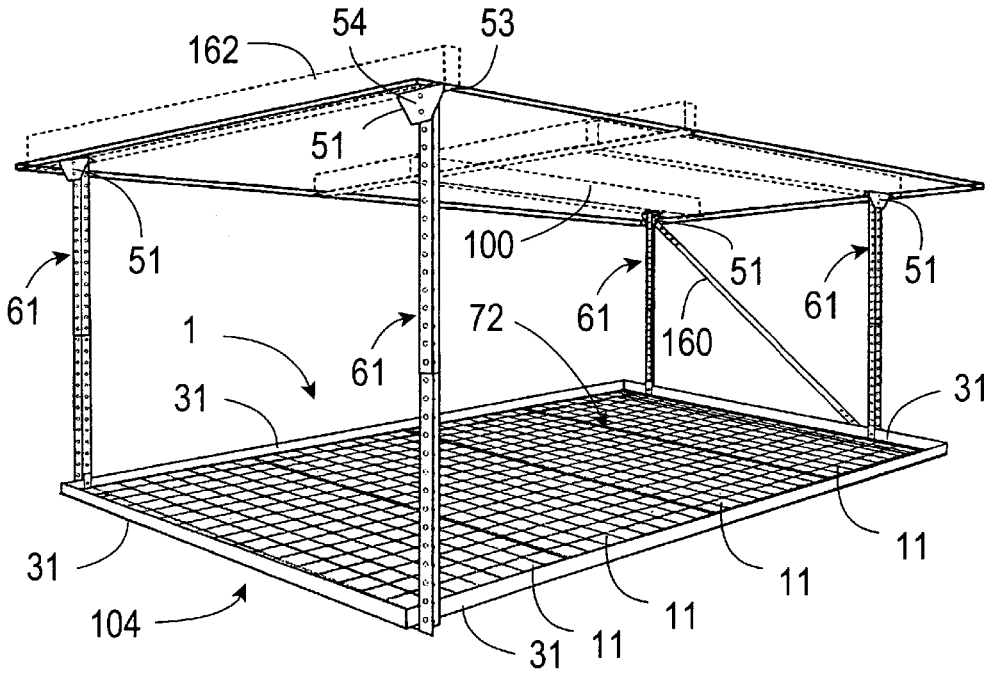
FIG. 17 shows an elevated perspective view of the suspended storage shelf of FIG. 16 with the suspension posts attached to a different location on the platform support elements.
Figure 18:
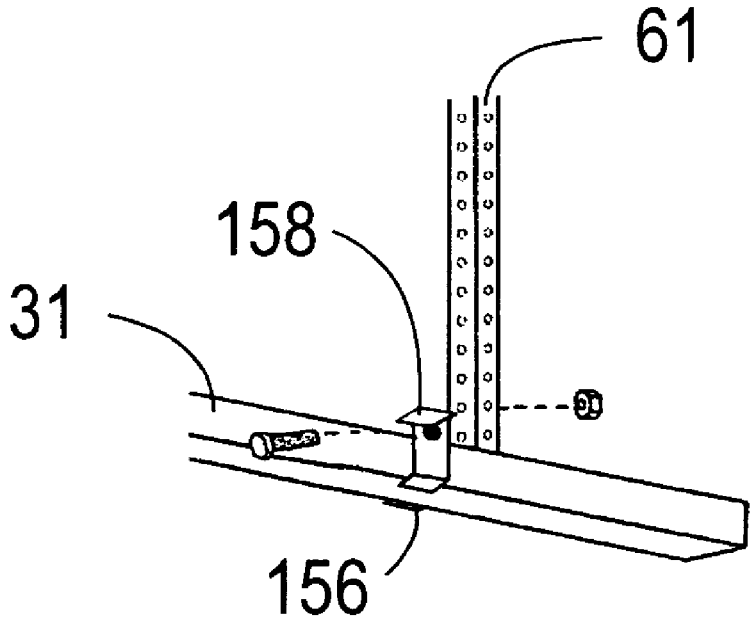
FIG. 18 shows an elevated perspective view of a locking plate according to an embodiment of the present invention

In yet another optional embodiment, illustrated in FIGS. 14-18, the platform support elements 31 and suspension posts 61 may be connected to one another at a plurality of locations relative to one another along the platform support elements 31. In such an optional embodiment, the connection locations may be discrete locations, or may be along a continuous range of locations. For example, in the optional embodiment of FIGS. 14-17, the suspension posts 61 may be connected to the platform support elements 31 anywhere along the platform support elements 31. Thus, one such optional embodiment would allow the suspension posts 61 positioned along two opposing platform support elements 31, as shown in FIG. 16, to be reconfigured with the suspension posts 61 positioned along three adjacent platform support elements 31, as shown in FIG. 17 or in any other fashion. While it is contemplated that a purpose for reconfiguration may be the orientation and spacing of the studs 162 in the overhead structure 100, it is noted that the location of the suspension posts 61 with respect to the platform support elements 31 may be influenced by many other considerations such as available space, access to the platform, or any other reason.

Figure 14:
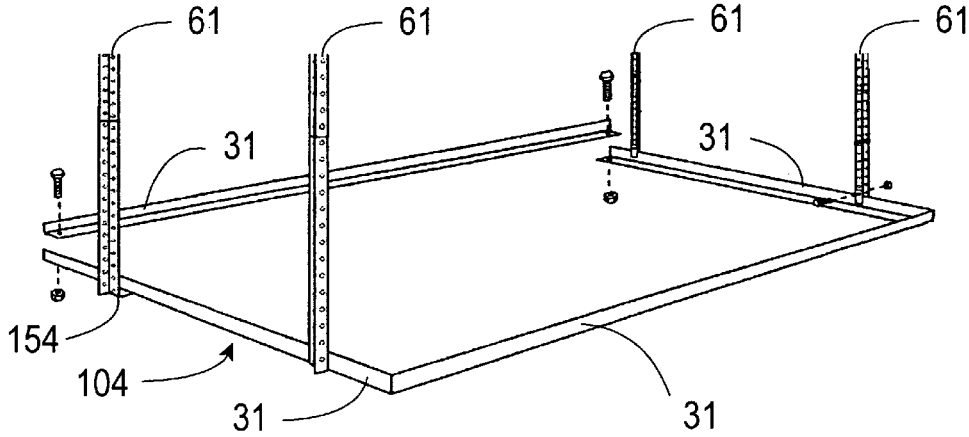
FIG. 14 shows an elevated perspective assembly view of a support frame according to an optional embodiment of the present invention.
Figure 15:
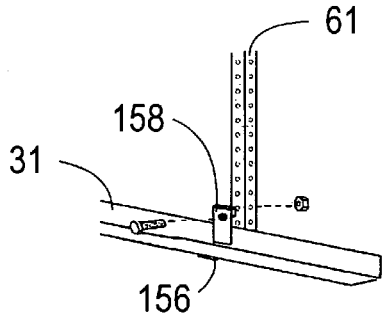
FIG. 15 shows an elevated perspective sectional view of a connector and lock according to an optional embodiment of the present invention.

In the optional embodiment of FIGS. 14-18, the suspension posts 61 attach to the platform support elements 31 through connectors 154. Optionally, the connectors 154 may be disengaged or loosened to allow the suspension post 61 and platform support element 31 to be repositioned or otherwise moved with respect to one another. For example, as illustrated in FIGS. 14 and 15, the connector may include a support flange 156 against which the platform support element 31 rests. In the example of FIGS. 14 and 15, the platform support element 31 rests on the support flange 156, but it is contemplated that the relationship between the support flange 156 and platform support element 31 could vary from this example.

In an optional embodiment, the connector 154 may include a lock that can assume a locked configuration, in which the suspension post 61 and platform support element 31 are secured, and an unlocked configuration, in which the suspension post 61 and platform support element 31 may move with respect to one another. Referring again to the optional embodiment of FIGS. 14, 15, and 18, the lock may take the form of a locking plate 158 that is removably attached to the suspension post 61. In a locked configuration, the locking plate 158 is secured to the suspension post 61 with at least a portion of the platform support element 31 sandwiched between the locking plate 158 and the suspension post 61 to thereby secure the platform support element 31 to the suspension post. In an unlocked configuration, the locking plate 158 is loosened or removed from the suspension post 61, thereby releasing the platform support element 31 and permitting relocation of the connection point between the suspension post 61 and the platform support element 31 by moving (in this example, sliding) the platform support element 31 and suspension post 61 with respect to one another. In addition to, or as an alternative for, the lock, cross-supports 160 may be provided to connect suspension posts 61 to one another. In an optional embodiment, the locking plate 158 may be configured so that it can be secured to differently shaped platform support elements 31. For example, in FIG. 18, the locking plate 158 may be reversible so that the locking plate 158 fits over a leg of an L-shaped platform support element 31 in one orientation, or over a channel shaped platform support element 31 in a reverse orientation.

Referring generally to FIGS. 1-18, the suspension posts 61 are optionally adjustable in length. For example, in one optional embodiment, the suspension posts 61 each include post elements 61*a*, 61*b* that may be selectively joined to adjust the length of a suspension post 61. More specifically, an upper post element 61*a* includes holes 65*a* therethrough. A lower post element 61*b* includes holes 65*b* therethrough. When the holes are aligned, mating bolts and nuts may retain the relative positions of the upper post element 61*a* and the lower post element 61*b* with respect to one another. By shifting the holes 65*a*, 65*b* aligned by increasing or decreasing the overlap between the upper post element 61*a* and lower post element 61*b*, the overall length of the support post 61 may be adjusted. In alternate optional embodiments (not shown), the post elements may mate, that is, an outer post element may receive an inner post element such that the length may be adjusted by inserting or removing the inner post element from the outer post element; or the post elements may engage one another end-to-end such that addition or removal of post elements alter the length.

As noted above and with reference generally to FIGS. 1-18, the support frame 104 is attached to the structure 100 through a fastener 51 such that the suspension posts 61 and the platform support element 31 cooperate to suspend the platform 72 from the structure 100. More specifically, the fastener 51 permits a transfer of the load on the platform 72 to the structure 100. The fastener 51 may take many forms. In its most elemental form, the fastener 51 is any hardware connecting the support frame 104 to the structure 100. For example, any bracket, threaded fastener, mating fastener, brad, anchor, or other attachment device could be used. Moreover, it is possible that the fastener 51 may be part of the support post 61, as discussed in greater detail below, or may have more than one piece, such as a toggle bolt, concrete anchor, wall anchor, or the like that cooperates with the fastener 51 to suspend the suspended storage shelf 1.

Figure 13:
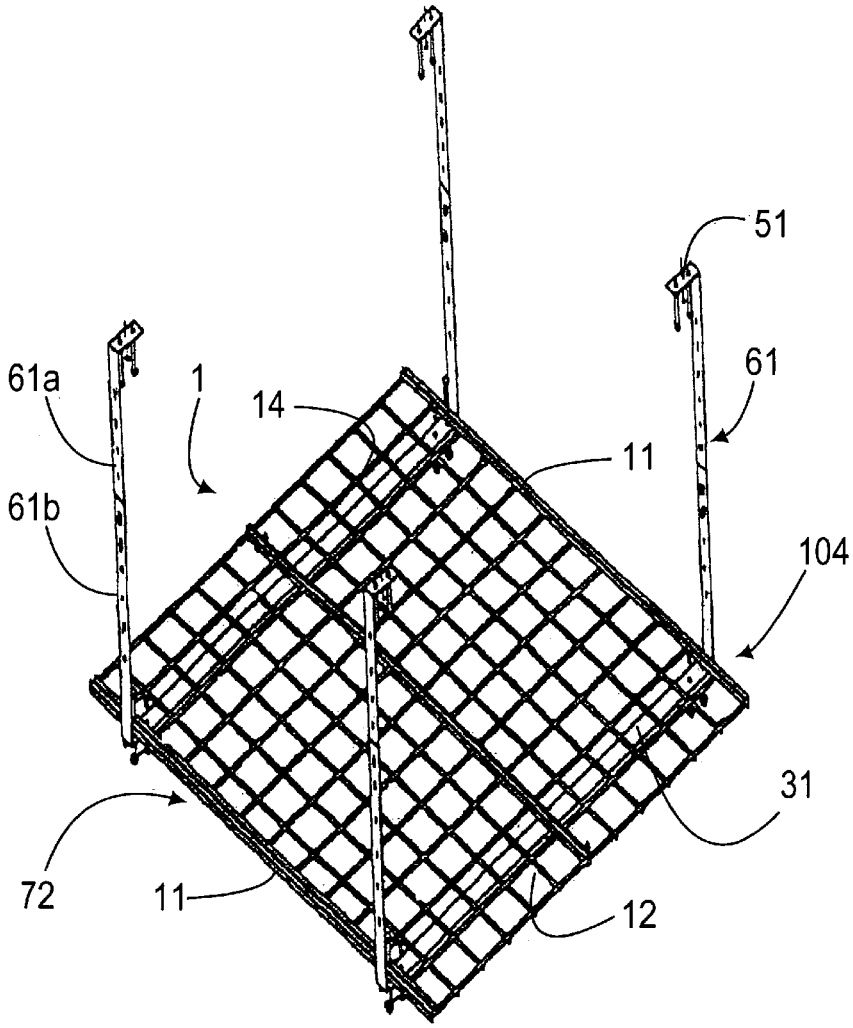
FIG. 13 shows an elevated perspective view of an alternate embodiment of a suspended storage shelf according to the present invention.

In the optional embodiment of FIGS. 1, 3, 16, and 17, for example, an angle bracket with two legs 53, 54 may be secured to an upper end of a support post 61. In such an optional embodiment, a first leg 53 with one or more holes 55 therethrough may be secured to the structure 100 using an attachment 57 such as a screw or bolt. A second leg 54 with one or more holes 56 therethrough may be secured to a support post 61 through a hole 65*a* in the support post 61. Alternatively, in the optional embodiment of FIG. 6, the fastener 51 is a flange 110 disposed at an end of a support post 61. For example, in the optional embodiment of FIG. 10, the flange 110 is connected to a receiver 112 that mates to an end of a support post 61. It is noted that in any of these optional embodiments, the fastener 51 may be removable from, fixed to, or integral with the support post 61. For example, in FIG. 13, the fastener 51 is an angle formed at the end of a support post 61. That is, the fastener 51 of the optional embodiment shown in FIG. 13 is not a separate piece but integrally formed with the support post 61.

While certain embodiments of the present invention have been shown and described it is to be understood that the present invention is subject to many modifications and changes without departing from the spirit and scope of the claims presented herein.

We claim:

1. A storage shelf for suspending from a structure, comprising:

a platform comprising one or more individual panels;

a support frame comprising:

at least one platform support element positioned along at least a portion of the perimeter of said platform in engagement with said platform to thereby support said platform;

at least two suspension posts including a connector, said connectors adapted to engage said platform support element in a sliding relationship, at least one of said connectors comprising a lock selectively engaging said platform support element, said lock having a locked configuration, in which said lock engages said platform support element to secure said platform support element from moving with respect to said connector, and an unlocked configuration, in which said lock disengages said platform support element such that said platform support element is free to slide with respect to said connector, whereby said suspension posts may be selectively engaged to said platform support element over a range of locations along said platform support element; and a fastener securing said support frame to said structure such that said suspension posts and said platform support element cooperate to suspend said platform from said structure.

2. The storage shelf of claim 1 wherein said suspension posts are selectively connectable to said platform support element at a plurality of discrete locations along said platform support element.

3. The storage shelf of claim 1 wherein said suspension posts are selectively connectable to said platform support element over a continuous range of locations along said platform support element.

4. The storage shelf of claim 1 wherein said connector further comprises a support flange against which said platform support element rests and said lock comprises a locking plate removably attached to said suspension post adapted to overlie and clamp said platform support element to said support flange when secured to said suspension post in said locked configuration.

5. The storage shelf of claim 1 wherein said platform support element has two ends, such that each said platform support element end extends beyond said platform.

6. The storage shelf of claim 1 wherein said support frame engages the perimeter of said platform.

7. The storage shelf of claim 1 wherein said platform comprises a plurality of panels and said support frame retains said panels adjacent one another.

8. The storage shelf of claim 1 wherein said platform comprises a plurality of panels, said storage shelf further comprising a coupling securing adjacent panels.

9. The storage shelf of claim 8 wherein said panels are formed from a grid of wire members and said coupling comprises a clamp securing adjacent wire members of adjacent panels.

10. The storage shelf of claim 1 wherein said platform is secured to said platform support element.

11. The storage shelf of claim 1 wherein each said suspension post is of adjustable length.

12. The storage shelf of claim 11 wherein each said suspension post has at least two post elements such that the length of each said suspension post is adjusted by selectively joining said post elements.

13. A storage shelf for suspending from a structure, comprising:

a platform comprising one or more individual panels, the edges of said platform defining the perimeter of said platform;

a support frame comprising:

at least two platform support elements assembled to engage and frame said perimeter of said platform to thereby support said platform;

at least two suspension posts including a connector, said connectors adapted to engage said a platform support element in a sliding relationship in which said platform support element is free to slide with respect to said connector whereby said suspension posts may be selectively engaged to said platform support element over a range of locations along said platform support element around the perimeter of said platform; and a fastener securing said support frame to said structure such that said suspension posts and said platform support element cooperate to suspend said platform from said structure.

14. The storage shelf of claim 13 wherein at least one of said connectors further comprises a lock adapted to selectively engage said platform support element, said lock having a locked configuration, in which said lock engages said platform support element to secure said platform support element from moving with respect to said connector, and an unlocked configuration, in which said lock disengages said platform support element such that said platform support element is free to slide with respect to said connector.

15. The storage shelf of claim 14 wherein said connector further comprises a support flange against which said platform support element rests and said lock comprises a locking plate removably attached to said suspension post adapted to overlie and clamp said platform support element to said support flange when secured to said suspension post in said locked configuration.

16. The storage shelf of claim 13 wherein said platform comprises a plurality of panels and said support frame retains said panels adjacent one another.

17. The storage shelf of claim 13 wherein said platform comprises a plurality of panels, said storage shelf further comprising a coupling securing adjacent panels.

18. The storage shelf of claim 17 wherein said panels are formed from a grid of wire members and said coupling comprises a clamp securing adjacent wire members of adjacent panels.

19. The storage shelf of claim 13 wherein said platform is secured to said platform support element.

20. The storage shelf of claim 13 wherein each said suspension post is of adjustable length.

21. The storage shelf of claim 20 wherein each said suspension post has at least two post elements such that the length of each said suspension post is adjusted by selectively joining said post elements.

22. The storage shelf of claim 13 wherein said suspension posts are selectively connectable to said platform support element at a plurality of discrete locations along said platform support element.

23. The storage shelf of claim 13 wherein said suspension posts are selectively connectable to said platform support element over a continuous range of locations along said platform support element.

* * * * *